US005397059A

United States Patent [19]

Baudin

[11] Patent Number: 5,397,059

[45] Date of Patent: Mar. 14, 1995

[54] DISPENSER EQUIPPED WITH A LIQUID PUMP AND A PRESSURIZED GAS/LIQUID NOZZLE

[75] Inventor: Gilles Baudin, Eragny Sur Oise, France

[73] Assignee: L'Oreal, Paris, France

[21] Appl. No.: 31,107

[22] Filed: Mar. 12, 1993

[30] Foreign Application Priority Data

Mar. 20, 1992 [FR] France ..... 92 03352
Mar. 20, 1992 [FR] France ..... 92 03354

[51] Int. Cl.[6] ..... B05B 7/24

[52] U.S. Cl. ..... 239/333; 239/353; 239/354; 239/367; 239/372; 239/424; 222/402.18; 222/402.2

[58] Field of Search ..... 239/333, 337, 340, 353, 239/354, 364, 367, 372, 373, 424; 222/484, 402.18, 402.2

[56] References Cited

U.S. PATENT DOCUMENTS 3,061,203 10/1962 Kitabayashi ..... 239/337
3,341,082 9/1967 Meshberg ..... 239/337 X
3,648,932 3/1972 Ewald et al. ..... 239/337
3,705,689 12/1972 Lee ..... 239/337
4,396,152 8/1983 Abplanalp ..... 239/337
5,110,052 5/1992 Graf et al. ..... 239/333
5,147,087 9/1992 Fuchs ..... 239/333
5,190,192 3/1993 Lina et al. ..... 222/402.2

FOREIGN PATENT DOCUMENTS 0307310 3/1989 European Pat. Off. .
0309010 3/1989 European Pat. Off. .
0451615 10/1991 European Pat. Off. .

*Primary Examiner*—William Grant
*Attorney, Agent, or Firm*—Staas & Halsey

[57] ABSTRACT

A liquid dispenser, equipped with a dispensing pump, bearing a dispensing nozzle including a central supply chamber arranged around an axis and a central outlet channel communicating, on the one hand, with the central chamber and, on the other hand, with the outside, and a receptacle including the liquid to be dispensed and pressurized gas. The dispensing nozzle also includes a peripheral supply chamber and a peripheral outlet channel, the peripheral supply chamber communicating with the pressurized gas through a valve which is closed when a push-button is at rest and open when the push-button is actuated.

16 Claims, 4 Drawing Sheets

DISPENSER EQUIPPED WITH A LIQUID PUMP AND A PRESSURIZED GAS/LIQUID NOZZLE

BACKGROUND OF THE INVENTION

The subject of the present invention is a liquid dispenser equipped with a dispensing pump.

A liquid to be dispensed contained in a receptacle is, as is known, advantageously dispensed in the form of a spray by the action of pressure. The latter may be obtained by virtue of the presence, in the receptacle, of a pressurized propellent gas. The disadvantage of this solution results from the necessity to put the receptacle under very high pressure from the start, in order to obtain a pressure which is still sufficiently high when the use of the dispenser comes to an end. In order to avoid this disadvantage, the gas is introduced in liquefied form into the dispenser. For these applications, the chosen gas is either of the type containing chlorofluorocarbons, and the harmful effect caused by this type of gas on the ozone layer is known, or propane and/or butane, which can create a problem of inflammability.

The dispensing pressure may also be obtained by manual actuation of the piston of a dispensing pump equipping the dispenser; unfortunately, this solution, even though it makes it possible to avoid the disadvantages described above, does not provide a spray which is as fine as that obtained by the solutions with propellent gas, particularly the solution with liquefied gas, in which each dispensed droplet is a mixture of liquid to be dispensed and of liquefied gas which, at the outlet of the dispensing nozzle, causes the drop to burst and makes it possible to obtain a microdiffusion of the dispensed fluid.

SUMMARY OF THE INVENTION

The subject of the present invention is a dispenser equipped with a pump for dispensing a liquid to be sprayed making it possible to obtain a much finer spray than that obtained with the dispensers equipped conventionally until now with a dispensing pump.

The liquid dispenser, according to the invention, equipped with a dispensing pump, comprises a receptacle containing the liquid to be dispensed, said dispensing pump being provided with a push-button the actuation of which introduces liquid to be dispensed into a compression chamber communicating with the volume of the liquid to be dispensed, then compresses the liquid in the chamber, then dispenses the liquid under pressure through a dispensing nozzle borne by the push-button, which dispensing nozzle comprises a central supply chamber arranged around an axis and a central outlet channel communicating, on the one hand, with the central chamber and, on the other hand, with the outside, wherein the dispenser contains, in addition to the liquid to be dispensed, pressurized gas, the dispensing nozzle comprising a peripheral supply chamber and a peripheral outlet channel communicating, on the one hand, with the peripheral chamber and, on the other hand, with the outside, the peripheral chamber surrounding the central chamber, and the peripheral channel surrounding the central channel, the two central and peripheral chambers as well as the peripheral channel being arranged circumferentially around the axis of the central chamber, the peripheral chamber communicating with the volume of the gas contained in the receptacle through a valve which is closed when the push-button is in its rest position and open when the push-button is actuated.

Also, by virtue of this arrangement, during operation, the pressurized gas hits, at the outlet of the nozzle, the liquid dispensed by the actuation of the pump, and improves the spray, particularly the fineness of the latter.

More precisely, the dispenser bears a cup closing the receptacle containing the liquid to be dispensed, the cup bearing, on the one hand, the pump equipped with the push-button and, on the other hand, a valve support having a control rod passing through it in a sealed manner, which rod is borne by the push-button and pierced with a channel communicating with an inlet, in the push-button, for supplying the peripheral chamber with pressurized gas.

The valve support preferably has a generally cylindrical shape, the inside of the cylinder communicating on the one hand with the volume of pressurized gas in the container, on the other hand with the channel, a ball in the valve support being forced by the pressurized gas towards a seat provided in the support, and by the rod away from this seat when the push-button is operated.

As a variant, the rod is mounted in a cylindrical bore in the same manner as a slide valve, the channel pierced in the control rod emerging laterally at the external surface of the rod by virtue of a return, the return being either closed off, at rest, or communicating with the pressurized gas by virtue of a groove in the internal wall of the valve support, a position for which the connection between the inside of the valve support and the volume of gas contained in the receptacle is closed.

In what precedes, the dispensing pump is conventional, perfectly sealed both at rest and during operation, the dispenser being arranged so that, when desired, the pressurized gas contained in the dispenser is brought to the peripheral chamber of the dispensing valve.

The subject of the present invention is also a dispensing pump comprising the means for supplying the central and peripheral chambers of the dispensing valve with liquid to be dispensed and with pressurized gas.

The dispensing pump, according to the invention, is characterized by the fact that the push-button of the pump is mounted in a sliding manner on a collar surrounding a cylindrical pump body to which it is secured, the collar being held on the receptacle of the container by its cup via a sealing washer, a hollow piston rod passing through the center of the collar, which rod is secured to the push-button and the inside of which rod communicates with the central chamber for its supply of liquid to be dispensed, the piston bearing a cylindrical bush, surrounding the piston rod, the lip-shaped end of which interacts with the external surface of a skirt borne by the collar, the skirt extending outside the piston rod and inside the bush of the piston, a first valve comprising a bearing surface intended to be applied on a seat under the action of a spring in order to close the supply to the central chamber, and a second valve comprising a bearing surface intended to be applied on a seat when the push-button is operated, in order to close the connection between the liquid to be dispensed contained in the receptacle and the inside of the body of the pump.

The first valve preferably comprises a first elongate part extending inside the piston rod and bearing the bearing surface, and a second elongate part extending outside the piston rod and interacting with the spring, the second valve being cylindrical and being guided by the second elongate part of the first valve which it surrounds, the second valve being made to interact, in a sealed manner, by a bearing surface with a seat borne by a widened part of the first valve located between the two elongate parts, the bearing surface and the seat making it possible to transmit to the second valve the force applied by the push-button to the first valve when it is operated, the bearing surface of the second valve consisting of its tubular end which is engaged on a sealing sleeve provided in the support, so that, when this engagement takes place, a compression chamber is defined between the pump support and its piston.

BRIEF DESCRIPTION OF THE DRAWINGS

In order to enable the subject of the invention to be better understood, an embodiment depicted on the attached drawing will be described below, purely by way of illustration and with no limitation being implied.

In this drawing.

DESCRIPTION OF THE PREFERRED EMBODIMENTS

Figure 1:
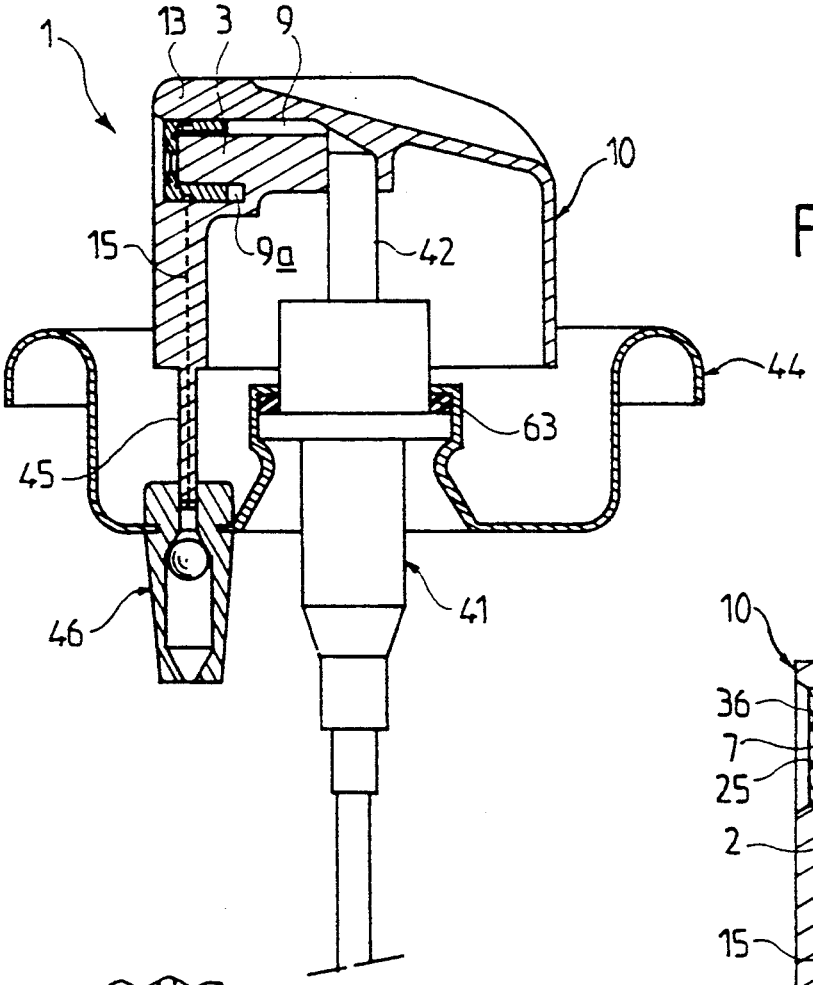
FIG. 1 depicts, in cross-section, a partial view of a liquid dispenser according to the invention.
Figure 2:
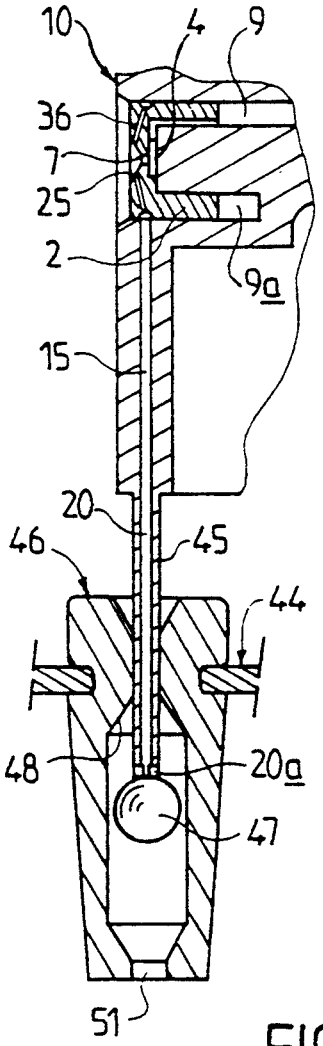
FIG. 2 is a view, on a larger scale, of a detail of FIG. 1.

Referring to FIGS. 1 and 2, a dispenser comprises a receptacle, closed by a cup 44, in the usual manner. From then on, the assembly of the dispenser is not depicted; the cup 44 bears, in a sealed manner, by virtue of a seal 63, a conventional pump 41 whose rod 42 for actuating the piston bears, in order to do this, a push-button 10, and whose plunger tube is plunged into the liquid to be dispensed contained in the receptacle; as is known, the rod 42 allows the liquid to be dispensed to pass during the actuation of the pump. The pump 41 is, for example, the pump manufactured by the PERFECT company, marketed under the commercial name "PZ AIRLESS".

The cup 44 also bears, according to the invention, a valve support 46 of generally cylindrical shape, the inside of which communicates, through a passage 51, with the internal space of the receptacle which is not occupied by the liquid to be dispensed. A control rod 45 passes through the valve support 46 in a sealed manner and is borne by the push-button 10, parallel to the axis of the pump 41; the rod 45 is pierced with a channel 20.

The valve support contains a ball 47, which is trapped but can move inside, a conical seat 48 provided at the upper part of the inside of the support 46 matching the shape of the ball which, when it interacts with it, prevents any connection from the inside of the receptacle towards the channel 20.

Figure 3:
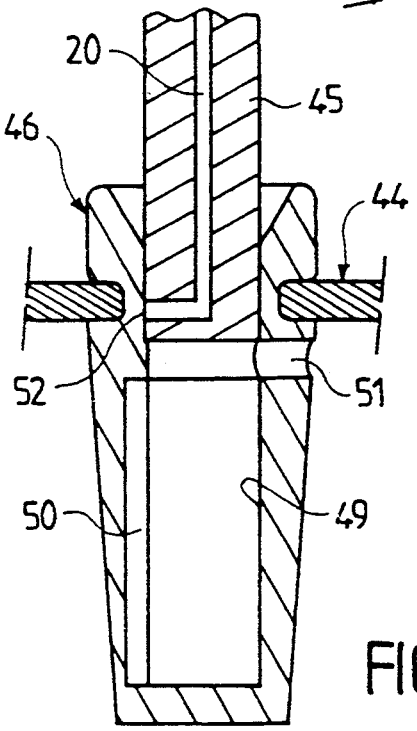
FIG. 3 depicts a variant of a part of the detail of FIG. 2.

The ball 47 may be replaced by a device of the "slide valve" type, as shown by the variant in FIG. 3; according to this variant, the internal bore 49 of the valve support 46, of generally cylindrical shape, corresponds to the external diameter of the control rod 45, which slides in the bore 49 in the same manner as a slide valve; the bore 49 communicates with the inside of the receptacle through a passage 51 passing through the wall of the support 46 located under the cup 44; the channel 20 of the rod 45 is bent at its lower part and emerges via an orifice 52 at the external surface of the rod 45. When the push-button is in its rest position, the orifice 52 is opposite the internal surface of the bore 49 and is thus closed off; after the push-button, and therefore the rod 45, have travelled sufficiently downwards, in FIG. 3, the orifice 52 faces a longitudinal groove 50 provided at the internal surface of the bore 49 and radially extending the bore.

Figure 6:
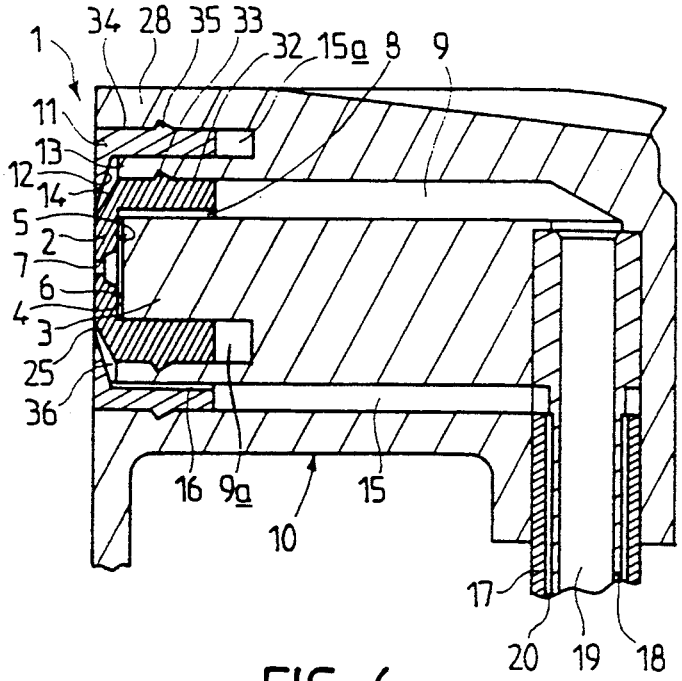
FIG. 6 depicts, in cross-section, a dispensing nozzle according to the invention.

The push-button 10 bears a dispensing nozzle 1 similar to that which is depicted in more detail in FIG. 6.

In FIG. 6, the dispensing nozzle designated as a whole by the reference 1, comprises a central cup 2 fitted onto a central end-piece 3 borne by the push-button 10; a central chamber 4 is thus defined by the internal face 5 of the central cup 2 and the external face 6 of the central end-piece 3. A central outlet channel 7 passes through the bottom of the central cup 2 and the cylindrical part of the central cup 2 is fitted, in a sealed manner, at 32, inside a peripheral end-piece 13 of the support, surrounding the central end-piece 3; the central cup 2 is held axially in the peripheral end-piece 13, for example by a clipping system at 33.

A peripheral cup 11 is fitted onto the peripheral end-piece 13, and, in a sealed manner, at 34 inside an outer end-piece 28 borne by the push-button, the outer end-piece 28 surrounding the peripheral end-piece 13; the peripheral cup 11 is held axially in the outer end-piece 28, for example by a clipping system at 35. A peripheral chamber 36 is thus defined between the internal face 12 of the peripheral cup 11, the external face of the peripheral end-piece 13 and the external face 14 of the central cup 2. The external face of the bottom of the central cup 2 and the internal face of the bottom of the peripheral cup 11 are conical so that the bottoms of the two cups are in a same plane perpendicular to the axis, a peripheral outlet channel 25 passing through the bottom of the peripheral cup has, when the cups are mounted in the support, an annular shape and surrounds the central channel 7.

The central chamber 4 is supplied with a liquid to be dispensed by a supply inlet 9 and a clearance 8, for example a longitudinal groove in the internal face of the central cup 2, between the central cup 2 and the end piece 3, which clearance 8 emerges into an annular space 9*a* of the support, the supply inlet 9 emerging into the annular space 9*a*. The peripheral chamber 36 is supplied by means of a supply inlet 15, an annular space 15, and a longitudinal groove 16 made on the internal face of the cylindrical wall of the peripheral cup 11.

In FIGS. 1 and 2, the supply inlet 15, instead of being parallel to the axis of the nozzle 1, is perpendicular to this axis, in the extension of the channel 20 of the control rod 45.

In the usual manner, the actuation of the pump 41 sprays the liquid to be dispensed through the central channel 7 of the nozzle 1 via the central chamber 4 supplied by the inlet 9 through the rod 42.

According to the present invention, the receptacle contains pressurized gas; thus, this same action on the push-button makes the space of the container containing the pressurized gas communicate with the channel 20, FIG. 2, the supply 15 to the peripheral outlet chamber 36 and therefore the peripheral channel 25. In fact, in the rest position, the rod 45 is at a distance from the ball 47 which is pressed, by the pressure of the gas, against its seat 48 but, during the operation of the pump, the rod 45 moves the ball off its seat and the pressurized gas is introduced into the channel 20, by virtue of radial passages 20*a* at the end of the rod 45.

As a result of the conical shape of the peripheral chamber, this gas flow hits, at the outlet, the flow of the liquid to be dispensed coming out of the central channel 7; this arrangement enables the dispensed liquid to be more effectively broken up, and therefore to be finer.

The sequences for dispensing liquid to be dispensed and gas may be varied. It is, for example, advantageous firstly to dispense gas, then simultaneously gas and liquid to be dispensed, and then once again only gas, which will clean the central channel 7 by entrainment by virtue of the reduced pressure created by the gaseous flow. These varied sequences are obtained by changing the relative lengths of the rods 42 and 45.

The breaking up of the dispensed liquid may be adapted to its type, particularly by adapting the central 7 and peripheral 25 channels, and/or the central 4 and peripheral 36 chambers.

Figure 7:
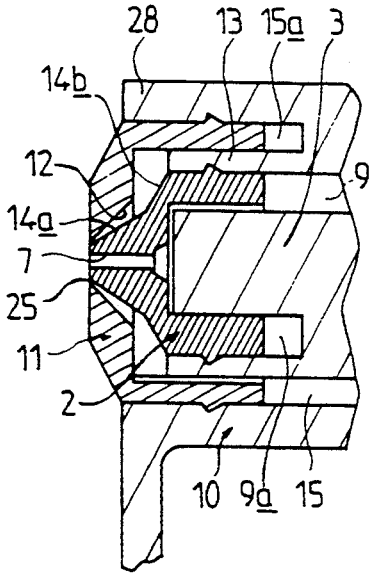
FIG. 7 depicts, in cross-section, a dispensing nozzle variant according to FIG. 6.

According to the variant in FIG. 7, the external face of the bottom of the central cup 2 is in two conical parts 14*a*, 14*b*, the angle of the part 14*a* being more acute than that of the part 14*b*; by virtue of this arrangement, the peripheral channel 25 is closer radially to the central channel 7.

Figure 8:
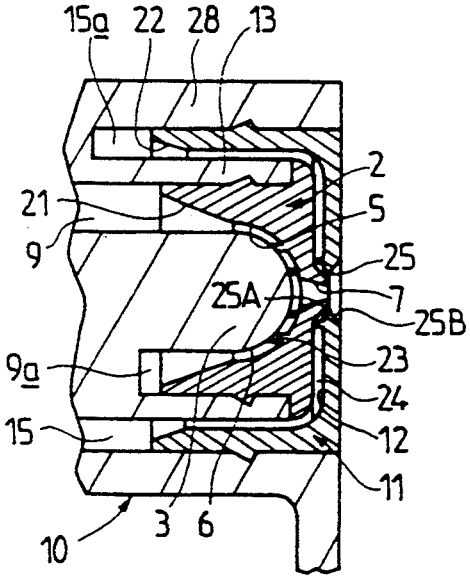
FIG. 8 shows, in cross-section, another dispensing nozzle variant according to the invention.
Figure 8A:
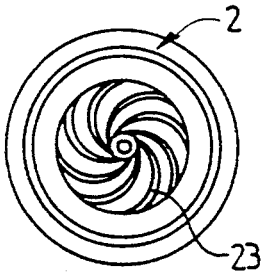
FIG. 8*a* is a side view showing the internal face of the central cup of the nozzle according to FIG. 8.

According to the variant in FIG. 8, the liquid to be dispensed is progressively precompressed before it is let out to the outside. In order to achieve this, the central and peripheral chambers have frustoconical annular volumes, at the inlet, which are limited, inter alia, by the conical portions 21 and 22 respectively of the internal faces of the central 2 and peripheral 11 cups. The hemispherical shape of the end of the external face of the central end-piece will also be noted in this figure, the part opposite the internal face 5 of the central cup 2 having a corresponding hemispherical shape, which internal face 5 of the central cup 2 being provided with helical fins 23, which can also be seen in FIG. 8*a*, so as to give the liquid to be dispensed a swirling motion. The central channel 7 has, in this case, a conical shape converging towards the opening of the channel to the outside.

Figure 8B:
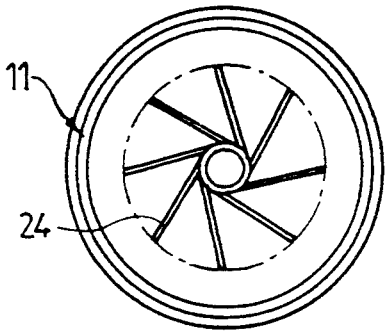
FIG. 8*b* is a side view showing the internal face of the peripheral cup of the nozzle according to FIG. 8.

According to this same variant in FIG. 8, the bottom of the peripheral cup 11 is flat, as is the external face of the central cup 2 located opposite; the internal face of the bottom of the peripheral cup 11 is provided with fins 24, which can also be seen in FIG. 8*b*; these fins 24 are planar, along planes which are parallel to the axis but without passing through the axis and are inclined by the same angle and in the same direction with respect to the radii which pass through their end which is furthest away from the axis; this arrangement makes it possible to give a swirling motion to the gas also; it will be noted that the swirls of liquid to be dispensed and of gas are in opposite directions so as to increase the breaking up. In the example in FIG. 8, the peripheral channel is formed of two truncated cones, one, 25A, being convergent, and the other, 25B, being divergent, the plane end perpendicular to the axis of the outlet of the central channel being arranged at the plane of connection of the two truncated cones 25A, 25B.

Figure 9:
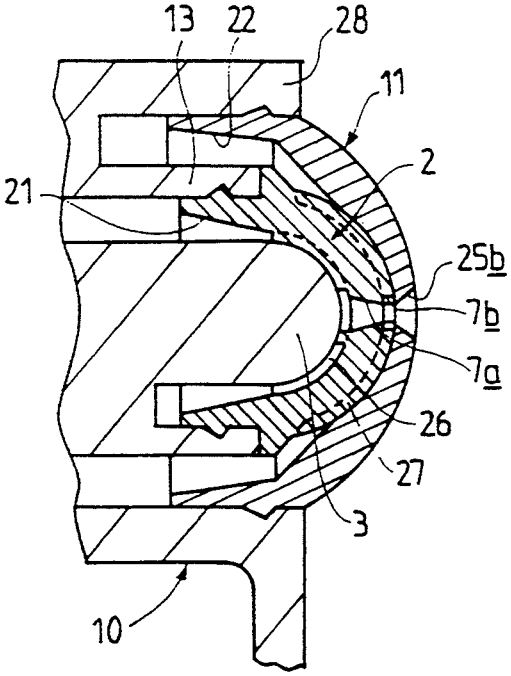
FIG. 9 is a cross-section showing another nozzle variant according to the invention.
Figure 9A:
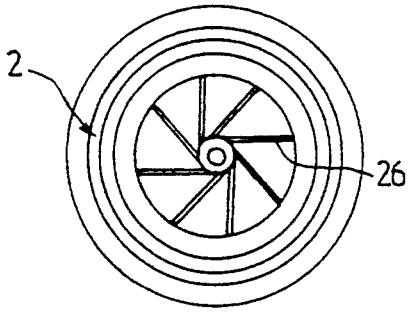
FIG. 9*a* is a side view showing the internal face of the central cup of the nozzle according to FIG. 9.
Figure 9B:
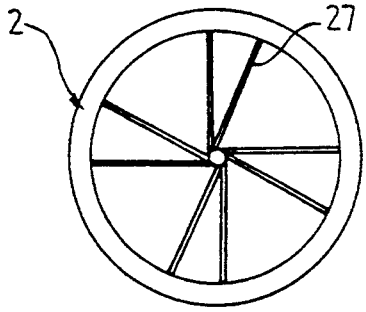
FIG. 9*b* is a side view showing the external face of the central cup of the nozzle according to FIG. 9.

The nozzle variant depicted in FIG. 9 comprises the advantageous arrangements of FIG. 8, that is precompression of the fluids by virtue of the frustoconical shapes 21, 22 of the internal faces of the cups, as well as swirling motions of the fluids; according to this variant, the fins 26, 27 causing these swirling motions are all borne by the bottom of the central cup. The fins of the type described with reference to FIG. 8*b*; the fins 26 are provided on the internal face of the central cup 2 and can also be seen in FIG. 9*a*, a view of the left of FIG. 9, and the fins 27 are provided on the external face of the central cup 2 and can also be see in FIG. 9*b*, a view of the right of FIG. 9.

The variant in FIG. 9 is also advantageous due to the relative arrangement and constitution of the central and peripheral channels. The central channel is conical converging outwards at 7*a*, and the peripheral channel is conical diverging outwards at 25*b*; the two truncated cones 7*a* and 25*b* are separated by a space 7*b* in which the fluids meet; this venturi-type arrangement causes the compression of the liquid to be dispensed at 7*a*, the meeting of the liquid to be dispensed and of the gas at 7*b*, the reduction in pressure of the mixture at 25*b*, and makes the spray finer and more homogeneous.

Figure 10:
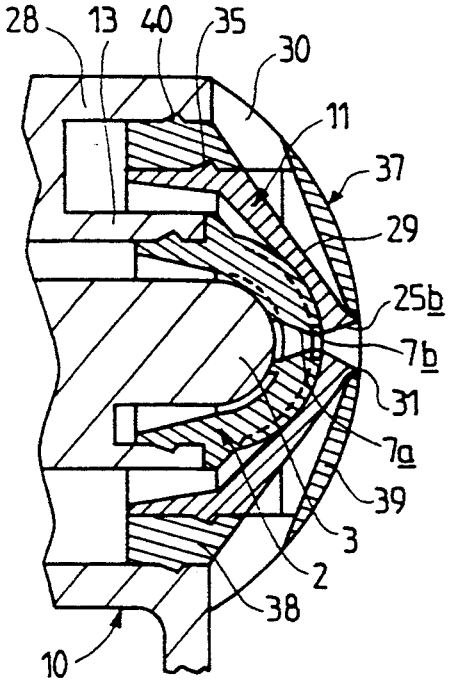
FIG. 10 is a cross-section showing another dispensing nozzle variant according to the invention.
Figure 10A:
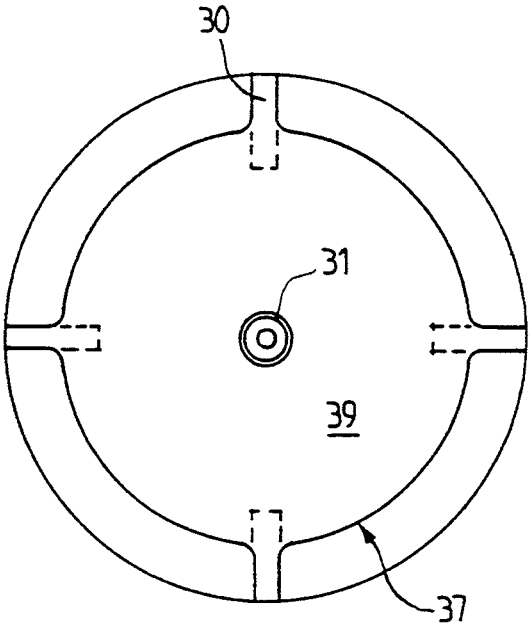
FIG. 10*a* is a side view showing the internal face of the cup-shaped cap of the nozzle according to FIG. 10.

The nozzle variant according to FIG. 10, and, in part, FIG. 10*a*, is similar to that in FIG. 9, to which there has been added a cup-shaped cap 37; the cap 37 consisting of a cylindrical skirt 38 and of a spherical cover 39, which are connected by radial ribs 30. The skirt 38 is fitted, in a sealed manner, on the one hand, onto the cylindrical external face of the peripheral cup 11 clipped at 35, and, on the other hand, inside the outer end-piece 28, clipped at 40, also in a sealed manner. The space located between the internal face of the cover 39 and the external face of the peripheral cup 11 defines a plurality of outwardly-convergent conical channels, the external face of the cup being provided in a conical shape as in 29 in FIG. 9; these channels distributed circumferentially around the axis emerge on either side outside, having an inlet, away from the axis, which is wider than the outlet near the axis; an annular outlet 31 is thus defined; this outlet 31 surrounds the outlet of the peripheral channel 25*b* and is close to the latter; by virtue of this arrangement, the reduced pressure prevailing at the outlet of the venturi 7*a*, 7*b*, 25*b* sucks in outside air which passes through these channels and also breaks up and aerates the sprayed liquid.

The dispensing nozzle variants described with reference to FIGS. 6 to 10*a* apply whatever the dispensing pump equipping the dispenser according to the invention. They also apply to the dispensing pump, also according to the present invention, particularly that described with reference to FIGS. 4 and 5.

Figure 4:
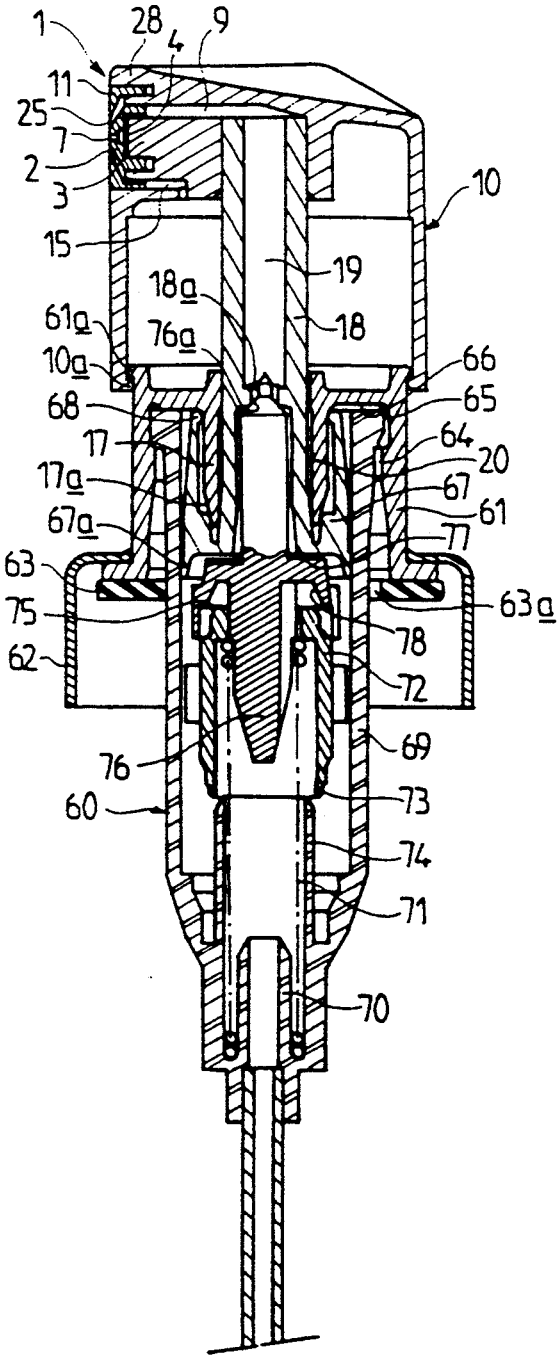
FIG. 4 shows, in cross-section, an embodiment variant of the dispensing pump equipping a liquid dispenser according to the invention.

In FIG. 4, the pump 60, according to the invention, comprises a cylindrical pump body 69; at the upper end of this pump body 69 there is attached, for example by clipping, a collar 61 which is held on the receptacle by a cup 62, via a sealing washer 63. The push-button 10 of the pump is mounted in a sliding manner along the external wall of the collar 61, which has a general hat shape, a hollow piston rod 18, secured to the push-button 10, passing through the center of the bottom of this collar; the inside 19 of the hollow rod 18 communicates, through a supply inlet 9, with the central chamber 4 of the dispensing nozzle 1 borne by the push-button 10. The piston, via its sealing lip 67*a*, slides inside the body 69 and bears a cylindrical bush 67 surrounding the piston rod 18, and extending in the opposite direction to the seal.

The collar 61 bears a cylindrical skirt 17 also surrounding the piston rod 18 but located inside the bush 67 of the piston; the end 68 of the bush 67, in the shape of a lip, interacts in a sealed manner with the external face of the skirt, at least over an axial length of the latter.

A first valve 76 comprises a first elongate part extending inside the piston rod 18 and bearing a conical part 76*a* intended to be applied onto a seat 18, constituted by the rim of a short hollow cylindrical part made in the inside 19 of hollow rod 18. A spring 71 interacts with a second elongate part of the first valve 76 which extends outside the piston rod 18.

A second valve 72 surrounds the second elongate part of the first valve 76; of cylindrical shape, the second valve bears, at one end, a conical part 75 intended to interact with a complementary conical seat 78 borne by a widened part of the first valve 76, located between its two elongate parts. At the opposite end to that which bears the conical part 75, the second valve 72 is equipped with a sealing bearing surface 73 intended to interact, in a sealed manner, with the external surface of a tubular sealing sleeve 74, provided coaxially in the pump body 69, the external surface of the sleeve 74 and the internal face of the support being connected at the lower end of the pump body 69. The extension of a hollow heel 70 makes it possible to connect a plunger tube to the pump body 69, as usual.

The receptacle containing pressurized gas, the constituent elements of the pump are depicted in FIG. 4 in the rest position, the push-button 10 being subjected to no action. In this position, the volume lying under the seat 18*a* in the piston rod, the pump body under the piston seal 67*a* and the plunger tube are filled with liquid to be dispensed. The spring 71 presses the first valve 76 onto the seat 18*a*, and the liquid, under the pressure from the pressurized gas contained in the receptacle, raises the piston-first valve-push-button assembly upwards until the end 68 of the bush 67 abuts against the edge of the collar 61; additional safety and sealing bearing surfaces are furthermore provided on the push-button and the collar, respectively internal 10*a*, and external 61*a*; the second valve 72 rests, under gravity, on the first turns of the spring 71 which surround the second elongate part of the first valve while projecting beyond its external surface, in this case made thinner in order to define the bearing of the spring on the first valve 76; in this position, the bearing surface 73 of the second valve is at a distance from the sleeve 74.

The pressurized gas is retained by the interaction of the end 68 of the bush 67 with the outer face of the skirt 17; in fact, the pressurized gas is present around the body 69 and inside the cup 62, passes the washer 63 at 63*a*, a space which is continuous 64 and localized at 65 between the body 69 and the collar 61, then a passage 66 provided on the upper rim of the body 69 opposite the bottom of the collar 61.

An action of the push-button 10 is transmitted to the piston rod 18 and to the first valve 76; the second valve firstly bears, via its bearing surface 73, on the edge of the seat 74 consisting of the sealing sleeve and, secondly, bears, via its conical part 75, on the seat 78, by means of which the force applied to the push-button 10 is transmitted to it. From this instant, a compression chamber is created, enclosing liquid between the pump body and the piston; with the push-button being lowered further, the liquid is dispensed, under the pressure of the pump, through the channel 7, via the passages 9 and 19 as usual, the force due to the pressure on the section 76*a* acting against that from the spring 71 in order to then open the first valve 76.

Figure 5:
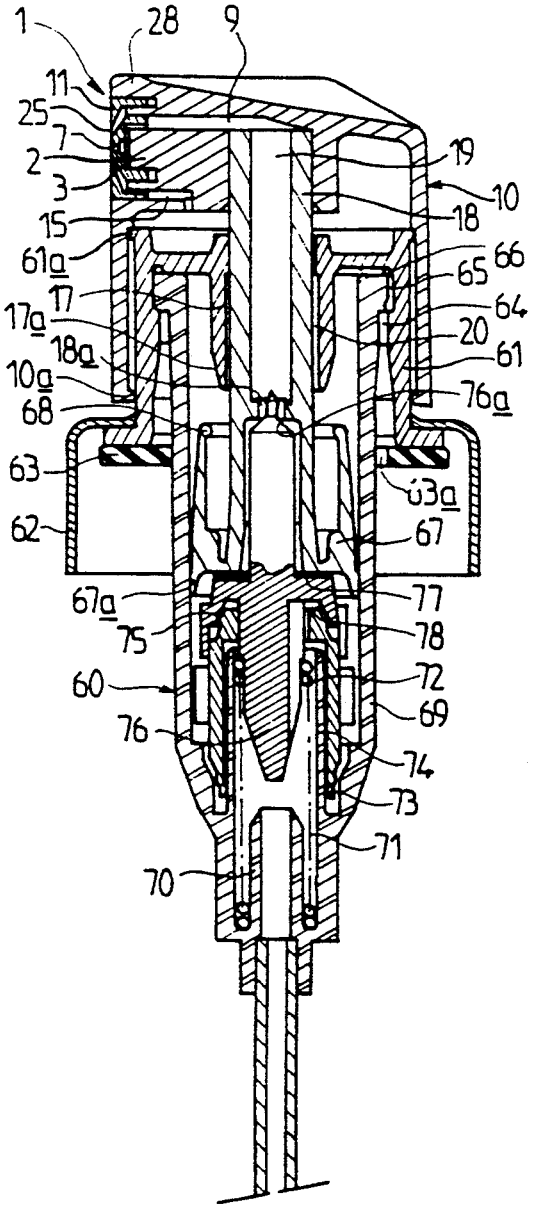
FIG. 5 depicts, in cross-section, the pump of FIG. 4, the piston of the pump being in a different position from that which it occupies in FIG. 4.

According to the invention, after a travel defined by the respective axial lengths of the bush 67 and of the skirt 17 and of the position of a portion 17*a* of smaller diameter of the skirt 17, the lip 68 of the bush no longer seals the pressurized gas and the latter is brought to the peripheral chamber of the nozzle 1 via the circular passage 20 between the skirt 17 and the rod 18, the inside of the push-button mounted at 10*a* and 61*a* in a sealed manner on the collar 61. The end of travel of the push-button and of the elements of the pump is shown in FIG. 5.

I claim:

1. Liquid dispenser, comprising:

a receptacle containing a liquid to be dispensed and pressurized gas; and a dispensing pump connected to the receptacle and having:

a push-button movable between a rest position and an actuated position, wherein actuation of the push button introduces the liquid from the receptacle into a compression chamber which communicates with the liquid, compresses the liquid, and then dispenses the liquid under pressure through a dispensing nozzle borne by the push-button, and a central supply chamber arranged around an axis and a central outlet channel communicating, on the one hand, with the central chamber and, on the other hand, with the outside of the dispenser, wherein the dispensing nozzle includes a peripheral supply chamber, and a peripheral outlet channel communicating, on the one hand, with the peripheral chamber and, on the other hand, with the outside, the peripheral chamber surrounding the central chamber and the peripheral channel surrounding the central channel, the central and peripheral chambers as well as the peripheral channel being arranged circumferentially around the axis of the central chamber, the peripheral chamber communicating with the gas contained in the receptacle through a first valve which is closed when the push-button is in the rest position and open when the push-button is actuated, and wherein the push-button is slidably mounted on a collar surrounding a cylindrical pump body to which the collar is secured, the collar is held on the receptacle by a cup via a sealing washer, a hollow piston rod which passes through a center of the collar is secured to the push-button, and an inside of which rod communicates with the central chamber for supplying the liquid to be dispensed, a piston bears a cylindrical bush and surrounds the piston rod, an end of the bush interacts with an external surface of a skirt borne by the collar, the skirt being radially outward of the piston rod and radially inward of the bush of the piston, a second valve includes a first bearing surface received by a first seat under the action of a spring in order to close off the inside of the piston rod to the central chamber, and a third valve includes a second bearing surface intended to be applied on a second seat when the push-button is actuated, in order to close the connection between the liquid contained in the receptacle and the inside of the pump body.

2. Liquid dispenser according to claim 1, wherein the second valve comprises a first elongate part extending inside the piston rod and bearing the first bearing surface, and a second elongate part extending outside the piston rod and interacting with the spring, the third valve being cylindrical and being guided by the second elongate part of the second valve which the third valve surrounds, the third valve being made to interact, in a sealed manner, by a third bearing surface with a third seat borne by a widened part of the second valve located between the two elongate parts, the third bearing surface and the third seat making it possible to transmit to the third valve a force applied by the push-button to the second valve when the push button is actuated, the third bearing surface of the third valve including a tubular end which is engaged on a sealing sleeve provided in the pump body, so that, when this engagement takes place, the compression chamber is defined between the pump body and the piston.

3. Liquid dispenser according to claims 1 or 2, wherein the central chamber is defined by a central cup fitted to a central end-piece supported by the push-button, between an internal face of the central cup and an external face of the central end-piece, the central outlet channel passing through the central cup.

4. Liquid dispenser according to claim 3, wherein the peripheral chamber is defined by a peripheral cup fitted to a peripheral end-piece supported by the push-button, between an internal face of the peripheral cup, an external face of the peripheral end-piece and the external face of the central end-piece, the peripheral outlet channel passing through the peripheral cup.

5. Liquid dispenser according to claim 4, wherein the central cup is fitted inside the peripheral end-piece.

6. Liquid dispenser according to claim 4, wherein the peripheral cup is fitted inside an outer end-piece of the push-button surrounding the peripheral end-piece.

7. Liquid dispenser according to claim 3, wherein at least one of the central outlet channel and peripheral outlet channel is cylindrical.

8. Liquid dispenser according to claims 1 or 2, wherein at least one of the central chamber and the peripheral chamber is cylindrical.

9. Liquid dispenser according to claims 1 or 2, wherein at least one of the central chamber and the peripheral chamber is an outward-convergent truncated cone.

10. Liquid dispenser according to claims 1 or 2, wherein at least one of the central chamber and the peripheral chamber is hemispherical.

11. Liquid dispenser according to claims 1 or 2, wherein at least one of the central chamber and the peripheral chamber is provided with fins imparting a swirling movement to fluid passing therethrough.

12. Liquid dispenser according to claims 1 or 2, wherein at least one of the central outlet channel and peripheral outlet channel is conical.

13. Liquid dispenser according to claims 1 or 2, wherein the central outlet channel has a conical shape converging towards an opening of the central outlet channel to the outside.

14. Liquid dispenser according to claims 1 or 2, wherein the central outlet channel has a tapered portion opening into the central chamber and a cylindrical portion opening to the outside.

15. Liquid dispenser according to claims 1 or 2, wherein the peripheral outlet channel is an outward-divergent truncated cone.

16. Liquid dispenser according to claims 1 or 2, wherein a cup-shaped cap is fitted to a peripheral cup and in an outer end-piece of the push-button, and, combined with a conical external face of the peripheral cup, defines a plurality of outwardly-convergent conical channels, distributed circumferentially about the axis, each channel having an inlet and an outlet, each inlet being away from the axis and wider than each corresponding outlet near the axis and communicating with the outside, and each outlet also communicating with the outside in the vicinity of an exit opening of the peripheral channel.

* * * * *